US006640764B2

(12) United States Patent
Tezuka et al.

(10) Patent No.: US 6,640,764 B2
(45) Date of Patent: Nov. 4, 2003

(54) PORTABLE POWER TOOL HAVING INTERNAL COMBUSTION ENGINE

(75) Inventors: Fuminori Tezuka, Iruma (JP); Tadashi Kamoshita, Asaka (JP); Masanori Ohtani, Machida (JP); Kentaroh Taka, Tokyo (JP)

(73) Assignee: Kioritz Corp., Tokyo (JP)

( * ) Notice: Subject to any disclaimer, the term of this patent is extended or adjusted under 35 U.S.C. 154(b) by 0 days.

(21) Appl. No.: 10/199,064

(22) Filed: Jul. 22, 2002

(65) Prior Publication Data

US 2003/0019460 A1 Jan. 30, 2003

(30) Foreign Application Priority Data

Jul. 27, 2001 (JP) ..... 2001-227050

(51) Int. Cl.[7] ..... F02B 63/00

(52) U.S. Cl. ..... 123/192.2; 123/192.1; 173/162.1

(58) Field of Search ..... 123/192.1, 192.2; 173/162.1

(56) References Cited

U.S. PATENT DOCUMENTS 3,563,222 A * 2/1971 Ishida ..... 123/192.1
4,351,202 A * 9/1982 Summers ..... 74/604
4,632,072 A * 12/1986 Brogdon ..... 123/55.4
4,819,593 A * 4/1989 Bruener et al. ..... 123/192.2
4,836,297 A 6/1989 Dorner et al. ..... 173/162.1
4,940,026 A * 7/1990 Fisher ..... 123/55.4
5,927,242 A * 7/1999 Kollock ..... 123/192.2

* cited by examiner

*Primary Examiner*—Willis R. Wolfe
*Assistant Examiner*—Douglas A. Salser
(74) *Attorney, Agent, or Firm*—Michael D. Bednarek; Shaw Pittman LLP

(57) ABSTRACT

A portable power tool includes an internal combustion engine that includes a crankshaft in which a load applied thereto is unevenly distributed along the axis of the crankshaft with respect to the axis of the reciprocating movement of a piston. The portable power tool also includes operational members that are driven by the internal combustion engine, a rotational body fixed to an end of the crankshaft to which a smaller component of the load is applied, and a balancing weight provided on the rotational body for absorbing vibrations generated by the reciprocating movement of the piston. The centroid of the balancing weight is disposed at an angular position from 140 degrees to 180 degrees with respect to the axis of the reciprocating movement of the piston in a rotational direction of the rotational body, when the piston is positioned at a top dead center.

15 Claims, 3 Drawing Sheets

PORTABLE POWER TOOL HAVING INTERNAL COMBUSTION ENGINE

BACKGROUND OF THE INVENTION

1. Field of the Invention

The present invention relates to portable power tools, and in particular, to a portable power tool having an internal combustion engine as a driving source for operational members of the tool, in which a load applied to the engine crankshaft is unevenly distributed along the axis thereof with respect to the axis of the reciprocating motion of a piston.

2. Description of the Related Art

In conventional portable power tools, a larger component of a load may be applied to an end of the crankshaft and unevenly distributed along the axis thereof. As a result, relatively large vibrations are generated at the end of the crankshaft to which the larger component of the load is applied. Because of the large vibrations, the operator of the power tool may experience an uncomfortable sensation.

While various countermeasures against vibration have been considered in the past, none have practically and effectively reduce vibration of the power tool due to the vibration generated at the crankshaft.

SUMMARY OF THE INVENTION

Accordingly, it is an object of the present invention to provide a novel and useful portable power tool having improved vibration absorption characteristics.

To this end, the present invention provides a portable power tool comprising an internal combustion engine that includes a crankshaft operatively connected to a piston that reciprocates along a predetermined axis. A load applied to the crankshaft is unevenly distributed along the axis of the crankshaft with respect to the axis of the reciprocating movement of a piston. An operational member is driven by the internal combustion engine. A rotational body is fixed to the end of the crankshaft to which a smaller component of the load is distributed. A balancing weight is provided on the rotational body for absorbing vibration generated by the reciprocating movement of the piston at the other end of the crankshaft, i.e., the end of the crankshaft to which a larger component of the load is distributed. The balancing weight is positioned to minimize vibration. Specifically, when the piston is positioned at a top dead center, the centroid (center of gravity) of the balancing weight is disposed at an angular position that is from 140 degrees to 180 degrees (with respect to the axis of the reciprocating movement of the piston) in a rotational direction of the rotational body.

In the internal combustion engine described above, the load applied to the crankshaft is unevenly distributed along the longitudinal axis of the crankshaft with respect to the longitudinal axis of the reciprocating movement of the piston. Therefore, a relatively large vibration due to the reciprocating movement of the piston is generated at the heavily loaded end of the crankshaft. However, the vibration of the power tool is effectively absorbed since the vibration is absorbed by the balancing weight provided at the rotational body on the lightly loaded end of the crankshaft. It has been found that the vibration is absorbed or avoided most effectively by positioning the centroid of the balancing weight, when the piston is at top dead center, at an angular position of 140 degrees to 180 degrees with respect to the axis of the reciprocating movement of the piston in a rotational direction of the rotational body.

According to the present invention, the balancing weight may be an additional weight formed independently from and mounted on the rotational body. Alternatively, the balancing weight may be formed integrally with the rotational body during its manufacture.

The centroid of the balancing weight is preferably positioned substantially at 160 degrees with respect to the axis of the reciprocating movement of the piston in the rotational direction of the rotational body, when the piston is positioned at a top dead center.

The rotational body may be a ratchet-pawl holder for transmitting the rotation of a recoil-starter reel included in a recoil starter to the crankshaft. In accordance with one aspect of the present invention, the balancing weight may be a centrifugal ratchet pawl mounted on the ratchet-pawl holder. With this arrangement, it is not necessary to provide an additional component part on the rotational body, whereby the number of component parts can be reduced and an additional space for mounting a balancing weight is not required.

According to another aspect of the present invention, a portable power tool comprises an internal combustion engine that includes a crankshaft operatively connected to a piston that reciprocates along a predetermined axis. A load applied to the crankshaft is unevenly distributed along the axis of the crankshaft with respect to the axis of the reciprocating movement of a piston. An operational member is driven by the internal combustion engine. The power tool also includes a recoil starter comprising a ratchet-pawl holder fixed to an end of the crankshaft to which a smaller component of the load is distributed. A centrifugal ratchet pawl is mounted on the ratchet-pawl holder. The relational arrangement between the mass of the centrifugal ratchet pawl and the position of the centrifugal ratchet pawl relative to the piston is selected to suppress vibration generated by the reciprocating movement of the piston at an end of the crankshaft to which a larger component of the load is distributed.

It is known to provide separately prepared weights added to various parts of an internal combustion engine to reduce vibration arrangement and provide dynamic balance of the internal combustion engine during its operation. However, in accordance with this aspect of the present invention, the centrifugal ratchet pawl serves also as a balancing weight. Consequently, there is no need for an additional part that acts as a balancing weight. Moreover, since the position of the centrifugal ratchet pawl relative to the piston can be set by controlling the mounting angle of the ratchet-pawl holder with respect to the crankshaft, the balancing weight can be easily positioned.

"The mass of the ratchet pawl" of the portable power tool according to this aspect of the present invention includes, other than the mass of the ratchet pawl itself, the mass of members for mounting the centrifugal ratchet pawl, such as a fixing member (e.g., screws) for mounting the ratchet pawl to the ratchet-pawl holder and an urging member (e.g., a spring) for restoring the centrifugal ratchet pawl.

The centroid of the centrifugal ratchet pawl is preferably disposed at an angular position (measured in a rotational direction of the ratchet-pawl holder) that is between 140 degrees to 180 degrees with respect to the axis of the reciprocating movement of the piston, when the piston is positioned at top dead center. In the currently preferred embodiment, the centroid of the centrifugal ratchet pawl is positioned substantially at 160 degrees with respect to the axis of the reciprocating movement of the piston in the rotational direction of the ratchet-pawl holder, when the piston is positioned at top dead center.

DESCRIPTION OF THE PREFERRED EMBODIMENTS

Figure 1:
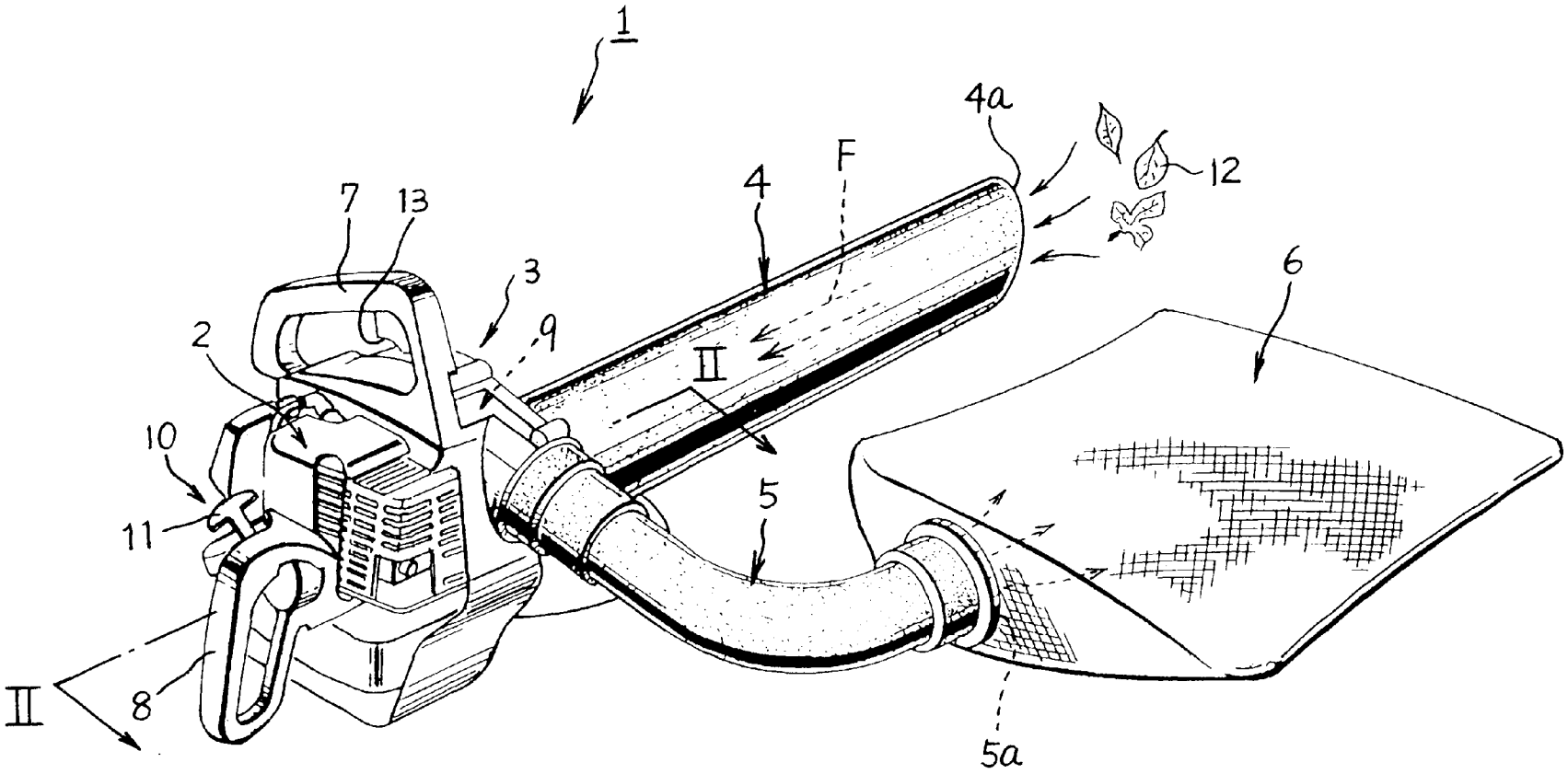
FIG. 1 is an overall perspective view of a portable handheld vacuum cleaner power tool according to an embodiment of the present invention.

In the embodiment shown in FIG. 1, the portable power tool is a vacuum cleaner 1 for the type typically used outdoors. Naturally, the present invention is applicable to other hand held power tools in which the load balance vibration problem discussed herein occurs. The vacuum cleaner 1 shown includes a main body 3 including an air-cooled two-cycle internal combustion engine 2 as a prime mover, a suction pipe 4 removably connected to the main body 3, a discharge pipe 5 removably connected to the main body 3. A dust bag 6 is removably connected to a discharge port 5*a* of the discharge pipe 5. The dust bag 6 is permeable to air. The main body 3 includes an upper handle 7 and a rear handle 8 at which an operator holds the vacuum cleaner 1 for controlling the position of the vacuum cleaner 1 while operating the same.

The main body 3 of the vacuum cleaner 1 is provided therein with a suction fan 9 (see FIG. 2) as an operational member driven by the internal combustion engine 2, which is an air-intake unit for generating an airflow F through the suction pipe 4. The operator starts the internal combustion engine 2 by pulling a starter handle 11 of a recoil starter 10. Once the engine 2 is started, the operator moves a suction port 4*a* disposed at an end of the suction pipe 4 close to debris 12 such as fallen leaves, twigs or grass to collect the debris 12 while operating a throttle trigger 13 disposed close to the upper handle 7. The debris 12 sucked into the suction pipe 4 is cut into pieces with a cutting blades 14 (see FIG. 2) rotating together with the suction fan 9 in the main body 3, and is discharged through the discharge pipe 5 with the airflow F, and is received or collected in the dust bag 6.

Figure 2:
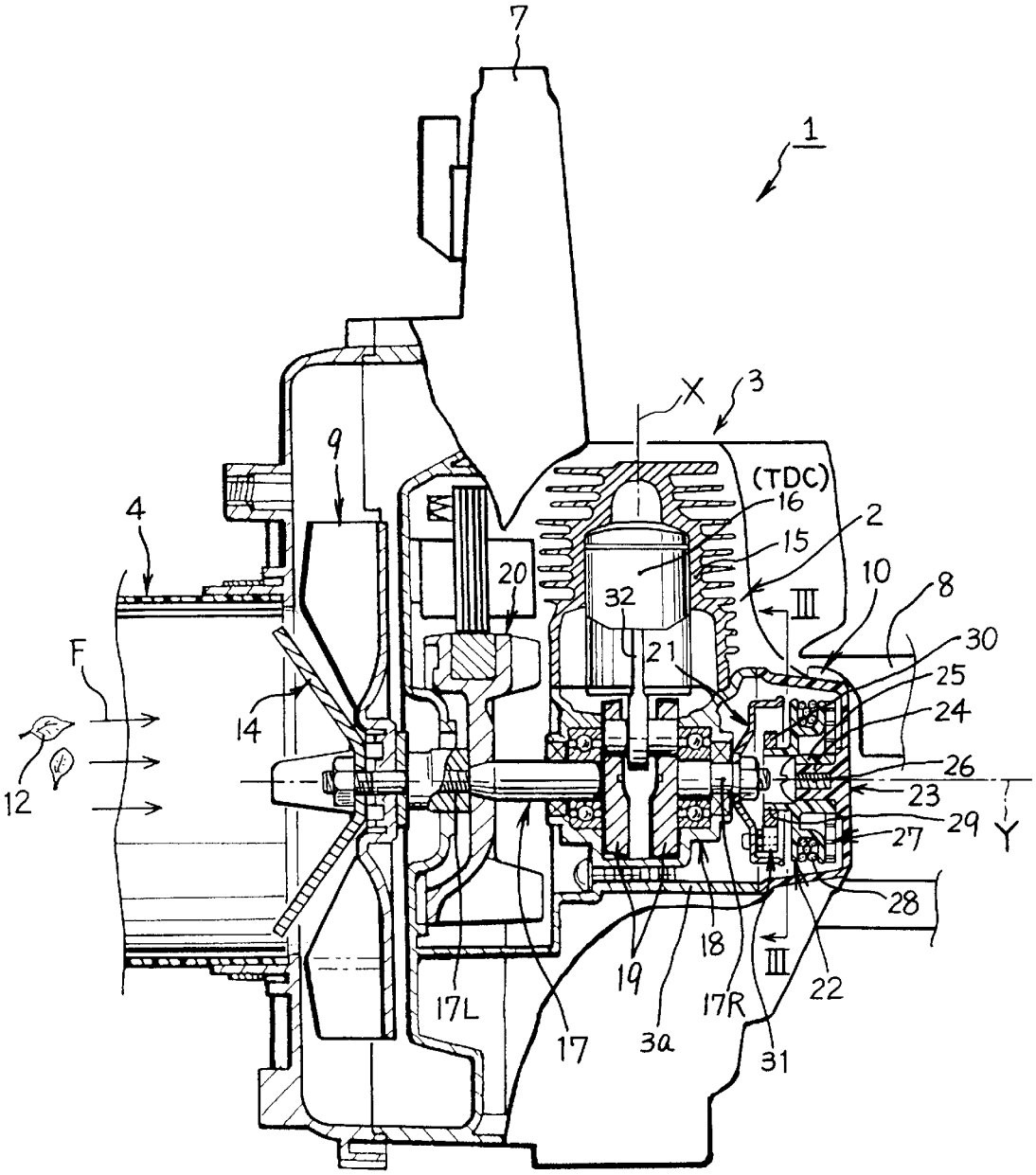
FIG. 2 is a sectional view along line II—II of the handheld vacuum cleaner shown in FIG. 1.

With reference to FIG. 2, the internal combustion engine 2 is provided with a conventional crankshaft 17 connected to a piston 16 in a cylinder 15 of the engine 2. As is customary, the crankshaft 17 is rotatably supported in a crankcase 18 and connected to the piston 16 via a connecting rod 32 so that the crankshaft 17 rotates about an axis Y as the piston 16 reciprocates within the cylinder 15. The crankshaft 17 is provided with a counter weight 19 formed integrally therewith for applying a balancing force in a direction opposite to the reciprocating movement of the piston 16 when the piston 16 rotates the crankshaft 17 via the connecting rod 32.

As shown in FIG. 2, a magneto rotor 20, the suction fan 9, and the cutting blade 14 are fixed to a left end 17L of the crankshaft 17 to which a relatively large load is applied. A ratchet-pawl holder 21 is fixed to a right end 17R of the crankshaft 17 to which a relatively small load is applied. The ratchet-pawl holder 21 is a rotating body for forming the recoil starter 10.

The recoil starter 10 includes a starter reel 22 opposing the ratchet-pawl holder 21. The starter reel 22 is rotatably supported in a starter case 23 that is removably fixed to a casing 3*a* for supporting the crankcase 18. In particular, a reel shaft 24 protrudes coaxially with the ratchet-pawl holder 21 in a central part of the starter case 23. A boss 25 of the starter reel 22 rotatably supported by the reel shaft 24 and is prevented from removing therefrom by a stopper screw 26. A spiral spring 27 is received between the starter reel 22 and the inner face of the starter case 23. The spiral spring 27 is anchored to the starter case 23 at the outer end thereof and to the boss 25 of the starter reel 22 at the inner end of the spiral spring 27. A starter rope 28 wound around the starter reel 22 is drawn against the resilient force of the spiral spring 27 by pulling the starter handle 11 (see FIG. 2), and is spooled back to the starter reel 22 by being released. A ratchet cam 30 for rotationally driving the ratchet-pawl holder 21 is fixed to the periphery of a boss-extending part 29 extending from the boss 25 of the starter reel 22 toward the ratchet-pawl holder 21.

Figure 3:
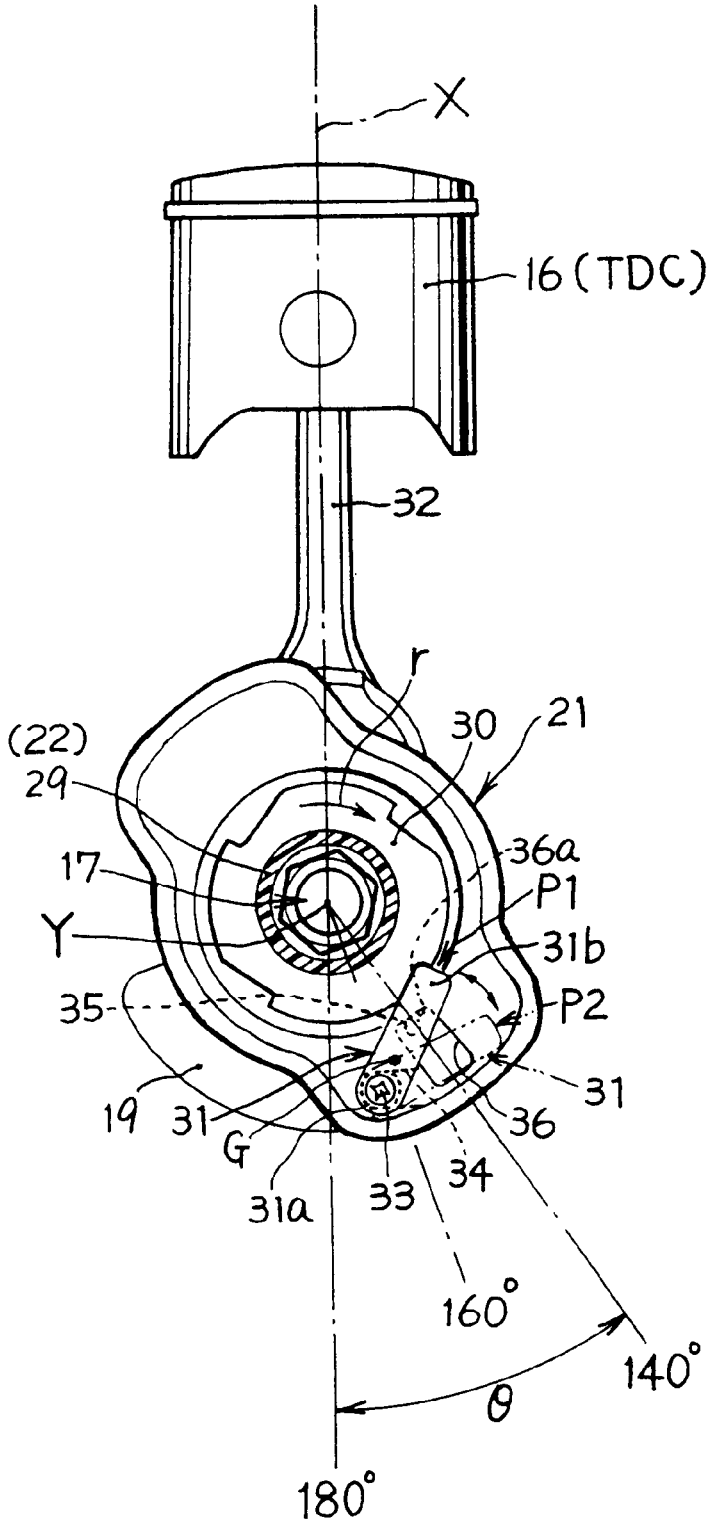
FIG. 3 is a sectional view along line III—III of the handheld vacuum cleaner shown in FIG. 2.

A centrifugal ratchet pawl 31 that can pivot and engage with the ratchet cam 30 is mounted on the ratchet-pawl holder 21. As shown in FIG. 3, the centrifugal ratchet pawl 31 is pivotably mounted on the ratchet-pawl holder 21 at a base end 31*a* of the ratchet pawl 31 via a ratchet-pawl pivot pin 33. The centrifugal ratchet pawl 31 is constantly urged by a return spring 34 so as to pivot in a direction toward a given engaging position P1, as shown by a solid line in FIG. 3. In this way, a pivoting end 31*b* of the ratchet pawl 31 is biased into engagement with the ratchet cam 30. To prevent the centrifugal ratchet pawl 31 from pivoting toward the inner side from the engaging position P1, the movement of the centrifugal ratchet pawl 31 is restricted by providing a stopper 35 on the centrifugal ratchet pawl 31. The stopper 35 contacts with an inner edge 36*a* of a slit 36 extending in the radial direction of the ratchet-pawl holder 21.

When the operator pulls the starter handle 11 connected to the starter rope 28, the starter reel 22 rotates clockwise in a direction r shown in FIG. 3. As a result, the ratchet-pawl holder 21, and thus the crankshaft 17, is driven for rotation via the ratchet cam 30 and the centrifugal ratchet pawl 31 engaging with each other. This, in turn, results in vertically reciprocation of the piston 16. When the internal combustion engine 2 starts to operate, the centrifugal ratchet pawl 31 is pivoted against the urging force of the return spring 34 with the pivoting end 31*b* thereof being flung out along the rotational plane of the ratchet-pawl holder 21 toward a releasing position P2 shown by a dash-double-dot line in FIG. 3 by a centrifugal force generated by high-speed rotation of the crankshaft 17. The centrifugal ratchet pawl 31 and the ratchet cam 30 are thus automatically released from the engaged state between each other.

In the embodiment shown, the load applied to the crankshaft 17 is significantly unevenly distributed along the axis Y of the crankshaft 17. In particular, as described above, the magneto rotor 20, the suction fan 9, and the cutting blades 14 are fixed to the left end 17L of the crankshaft 17. In contrast, only the ratchet-pawl holder 21 is fixed to the other, right end 17R of the crankshaft 17. The magneto rotor 20, which includes a magnet, has a large mass. The weight of the suction fan 9 is also significant because the suction fan 9 is made large enough to produce strong airflow F. The mass of the cutting blades 14, which are made of steel, is also great so that the cutting blades 14 are able to cut debris 12 effectively into pieces. In comparison to the total mass of these components, the mass of the ratchet-pawl holder 21 is far smaller. The uneven distribution of load occurs along the axis Y of the crankshaft 17 with respect to an axis X of the reciprocating movement of the piston 16. Because of this uneven distribution of load, large vibrations are generated at the heavily loaded end (i.e., the left end 17L shown in FIG. 2) when the crankshaft 17 rotates at a high speed. These vibrations result in significant vibration of the vacuum cleaner 1 during operation and the operator experiences an uncomfortable sensation.

To suppress the uncomfortable vibrations due to unevenly applied load to the left and right ends 17L and 17R of the crankshaft 17, a rotational body is provided with a balancing weight that functions to absorb vibrations generated by the reciprocation of the piston 16. In the embodiment shown, the rotational body is the ratchet-pawl holder 21 disposed at the right end 17R of the crankshaft 17 to which a smaller component of the load is applied. According to a particular aspect of the present embodiment, the centrifugal ratchet pawl 31 serves as a balancing weight, thereby reducing the number of component parts.

The centrifugal ratchet pawl 31 is preferably made of a heavyweight material such as iron so that it functions as a balancing weight. The mass of parts for mounting the centrifugal ratchet pawl 31 on the ratchet-pawl holder 21, i.e., the ratchet-pawl pivot pin 33 and the return spring 34, also serve as a balancing weight together with that of the ratchet pawl 31.

Forming the centrifugal ratchet pawl 31 of a heavyweight material such as iron is an important and non-obvious aspect of the present invention resulting from the inventors recognition of the load imbalance problem that leads to vibration. In the past, the centrifugal ratchet pawl mounted on a ratchet-pawl holder has been generally made of a lightweight material such as a plastic, so that it can be easily flung out to the releasing position with a small centrifugal force. Thus, conventionally the mass of the centrifugal ratchet pawl has been reduced to something on the order of 1 gram. Contrary to the conventional approach, the mass of the centrifugal ratchet pawl 31 according to the present embodiment is preferably set to approximately 7 grams by using a heavyweight material such as iron or the like. From this, it can be said that the centrifugal ratchet pawl should preferably have a mass that is at least five times greater than a lightweight plastic part having the same shape.

In addition, the size and shape of the centrifugal ratchet pawl 31 are preferably the same as those of the conventional centrifugal ratchet pawl made of a lightweight plastic material. Therefore, there is no need for a large space in the ratchet-pawl holder 21 for mounting the ratchet pawl 31, and the ratchet pawl 31 can be therefore mounted in a conventional recoil starter. In this way, the increased mass need to reduce vibration is achieved through the use of a heavyweight material (e.g., iron) as opposed to the conventional lightweight plastic material.

The present invention also includes a preferable relationship of positions between the piston 16 and the centrifugal ratchet pawl 31 serving as a balancing weight. In particular, the inventors performed vibration tests on the vacuum cleaner 1 by varying the angular position of the centrifugal ratchet pawl 31 on the ratchet-pawl holder 21 with respect to the axis X of the reciprocating movement of the piston 16. The angular position of the centrifugal ratchet pawl 31 with respect to the axis X can be easily controlled by varying the angular position of the ratchet-pawl holder 21 about the axis Y of the crankshaft 17.

As a result of the vibration tests, the inventors found that, to suppress vibrations, the centrifugal ratchet pawl 31 should preferably be positioned at an angular range θ in which a centroid (center of gravity) G of between 140 degrees to 180 degrees from the axis X of the reciprocating movement of the piston 16 in the rotational direction r of the ratchet-pawl holder 21, when the piston 16 is at a top dead center TDC. This relationship is illustrated in FIG. 3. That is, when the centroid G of the centrifugal ratchet pawl 31 was disposed at an angular position of 140 degrees in the preferable angular range θ, a significant anti-vibration effect started to be confirmed at the upper handle 7, which is a part that contacts the operator's body. As the centroid G of the centrifugal ratchet pawl 31 comes closer to the angular position of 160 degrees within the preferable angular range θ, the vibration acceleration level was lowered. When the centroid G of the centrifugal ratchet pawl 31 reached the angular position of 160 degrees, the vibration acceleration level became the lowest. Although the vibration acceleration level became higher as the centroid G of the centrifugal ratchet pawl 31 moved closer to the angular position of 180 degrees, a significant anti-vibration effect was confirmed. However, the angular position is preferably less than 180 degrees.

The vibration acceleration levels were measured at an upper handle of a vacuum cleaner using a conventional centrifugal ratchet pawl made of a plastic and having a weight of approximately 1 gram and also at the upper handle 7 of the vacuum cleaner 1 using the centrifugal ratchet pawl 31 made of iron and having a weight of approximately 7 grams. As a result, it was confirmed that the vibration acceleration level of the vacuum cleaner 1 could be reduced to less than half of the vibration acceleration level of the conventional known vacuum cleaner by employing the present inventions as described in connection with the present embodiment.

According to the present embodiment, the relational arrangement between the mass of the centrifugal ratchet pawl 31 and the position of the centrifugal ratchet pawl 31 relative to the piston 16 was considered, as described above, whereby vibrations generated at the left end 17L of the crankshaft 17 to which greater or larger component of the load was applied was suppressed and the vibration of the vacuum cleaner 1 was thereby significantly reduced.

Although according to the present embodiment, a centrifugal ratchet pawl made of a material having a specific gravity greater than that of a conventional ratchet pawl is used as a balancing weight, the present invention is not limited to this arrangement. A weight having the same advantage as that of the balancing weight described above may be mounted on the ratchet-pawl holder 21 by using an appropriate fixing member such as a screw. Alternatively a balancing weight may be formed integrally with the ratchet-pawl holder 21.

What is claimed is:

1. A portable power tool comprising:

an internal combustion engine including a crankshaft that rotates about a first axis, at least one piston that reciprocates along a second axis, the piston being operatively connected to the crankshaft, wherein a load applied to the crankshaft is unevenly distributed along the first axis of the crankshaft with respect to the second axis of reciprocating movement of the piston;

an operational member fixed to one end of the crankshaft and driven by the internal combustion engine;

a rotational body fixed to another end of the crankshaft to which a smaller component of the load is distributed; and a balancing weight provided on the rotational body, for absorbing vibration generated by the reciprocating movement of the piston at the one end of the crankshaft to which a larger component of the load is distributed, wherein a centroid of the balancing weight is disposed at an angular position that is from 140 degrees to 180 degrees with respect to the second axis of the reciprocating movement of the piston in a rotational direction of the rotational body, when the piston is positioned at a top dead center.

2. The portable power tool according to claim 1, wherein the centroid of the balancing weight is positioned substantially at 160 degrees with respect to the second axis of the reciprocating movement of the piston in the rotational direction of the rotational body, when the piston is positioned at a top dead center.

3. The portable power tool according to claim 1, wherein the rotational body is a ratchet-pawl holder for transmitting the rotation of a recoil-starter reel included in a recoil starter to the crankshaft.

4. The portable power tool according to claim 3, wherein the balancing weight is a centrifugal ratchet pawl mounted on the ratchet-pawl holder.

5. The portable power tool according to claim 4, wherein the centrifugal ratchet pawl has a weight sufficient to substantially counteract the vibration generated by the reciprocating movement of the piston at the one end of the crankshaft to which the larger component of the load is distributed.

6. The portable power tool of claim 5 wherein the ratchet pawl is comprised at least in part of iron.

7. A portable power tool comprising:

an internal combustion engine including a crankshaft in which a load applied thereto is unevenly distributed along a longitudinal axis of a crankshaft with respect to a longitudinal axis of the reciprocating movement of a piston;

an operational member driven by the internal combustion engine; and a recoil starter comprising:

a ratchet-pawl holder fixed to an end of the crankshaft opposite to that of the operational member; and a centrifugal ratchet pawl mounted on the ratchet-pawl holder, wherein the relational arrangement between the mass of the centrifugal ratchet pawl and the position of the centrifugal ratchet pawl relative to the piston suppresses vibration generated by the reciprocating movement of the piston at an end of the crankshaft to which a larger component of the load is distributed.

8. The portable power tool according to claim 7, wherein the centrifugal ratchet pawl is comprised at least in part of iron.

9. The portable power tool according to claim 7, wherein a centroid of the centrifugal ratchet pawl is disposed at an angular position from 140 degrees to 180 degrees with respect to the longitudinal axis of the reciprocating movement of the piston in a rotational direction of the ratchet-pawl holder, when the piston is positioned at a top dead center.

10. The portable power tool according to claim 9, wherein the centroid of the centrifugal ratchet pawl is positioned substantially at 160 degrees with respect to the longitudinal axis of the reciprocating movement of the piston in the rotational direction of the ratchet-pawl holder, when the piston is positioned at a top dead center.

11. In a portable power tool that includes an internal combustion engine having a at least one reciprocating piston operatively connected to a crankshaft, an operational member driven by the internal combustion engine; and a recoil starter comprising a ratchet-pawl holder fixed to an end of the crankshaft opposite to that of the operational member; and a centrifugal ratchet pawl mounted on the ratchet-pawl holder, wherein a load applied to the crank shaft is unevenly distributed along a longitudinal axis of a crankshaft with respect to a longitudinal axis of the reciprocating movement of a piston, a method of suppressing vibration generated by the reciprocating movement of the piston comprising forming the centrifugal ratchet pawl of a heavyweight material.

12. The method of claim 11, wherein the centrifugal ratchet pawl is comprised at least in part of iron.

13. The method of claim 11, wherein the centrifugal ratchet pawl has a mass that is at least five times greater than a lightweight plastic part having the same shape.

14. The method of claim 11, further comprising selecting the relational arrangement between the mass of the centrifugal ratchet pawl and the position of the centrifugal ratchet pawl relative to the piston to suppresses vibration generated by the reciprocating movement of the piston at an end of the crankshaft to which a larger component of the load is distributed.

15. The method of claim 14, wherein a centroid of the centrifugal ratchet pawl is disposed at an angular position from 140 degrees to 180 degrees with respect to an axis of the reciprocating movement of the piston in a rotational direction of the ratchet-pawl holder, when the piston is positioned at a top dead center.

* * * * *